United States Patent [19]

Rappleyea

[11] 4,326,303

[45] Apr. 27, 1982

[54] PROTECTIVE HEADGEAR

[75] Inventor: Frederick A. Rappleyea, Park Ridge, Ill.

[73] Assignee: The Kendall Company, Boston, Mass.

[21] Appl. No.: 146,957

[22] Filed: May 5, 1980

[51] Int. Cl.[3] ..... A42B 3/82

[52] U.S. Cl. ..... 2/411; 2/425

[58] Field of Search ..... 2/425, 411-422

[56] References Cited

U.S. PATENT DOCUMENTS

| | | | |
|---|---|---|---|
| 2,634,415 | 4/1953 | Turner et al. | 2/414 |
| 2,758,304 | 8/1956 | McGowan | 2/411 |
| 3,174,155 | 3/1965 | Pitman | 2/411 |
| 4,060,855 | 12/1977 | Rappleyea | 2/413 |

FOREIGN PATENT DOCUMENTS

| | | | |
|---|---|---|---|
| 960002 | 12/1974 | Canada | 2/411 |

*Primary Examiner*—Louis Rimrodt

*Attorney, Agent, or Firm*—Powell L. Sprunger

[57] ABSTRACT

Protective headgear comprising, a relatively rigid shell for covering the wearer's head. The headgear has a bumper for the shell comprising, a flexible cover attached to a front of the shell adjacent a lower front edge of the shell, with the cover having a recess facing the shell, and a pad of high energy attenuation material received in the recess.

9 Claims, 5 Drawing Figures

PROTECTIVE HEADGEAR

BACKGROUND OF THE INVENTION

The present invention relates to protective equipment, and more particularly to protective headgear.

A various assortment of protective headgear or helmets has been proposed in the past for protecting the wearer's head in the event of a collision. Such helmets have been widely utilized by participants in a number of sports, where the possibility of head injury is great, such as football, hockey and baseball, and for other purposes, such as crash helmets. At an earlier time, it was somewhat unclear how much protection the helmets actually afforded to the user, and, if the wearer suffered a head injury in spite of the helmet, it apparently was accepted that the shock to the head resulting from the impact may have been greater than could reasonably be protected by the headgear.

More recently, technology has been applied to determine exactly what happens to the wearer's head when the helmet is subject to impact. In particular, tests have been devised to measure the forces which are actually transmitted to the head responsive to a blow against the helmet. For example, drop tests are currently being used to determine these forces. An accelerometer may be placed in a metal head form, and the helmet to be analyzed is fitted and placed on the form. The helmet and form assembly are then raised to a height above a striking surface, after which the assembly is dropped against the surface, with information from the accelerometer being recorded during this time. Of course, the assembly may be adjusted to select the desired impact point on the helmet. The data from the input axis of the accelerometer may be translated to the vertical drop axis to determine the forces which are transmitted through the helmet to the form. In this manner, a given helmet may be analyzed to learn whether it will perform adequately under conditions of use.

It has been found that in many cases current helmets do not afford the amount of protection expected or desired. In particular, the front of the current helmets may be considered to be the weakest part of the helmet in that the front part transmits the most energy to the wearer's head.

SUMMARY OF THE INVENTION

A principal feature of the present invention is the provision of a protective helmet which has improved energy absorbing capabilities to dissipate forces applied against the helmet.

The protective headgear of the present invention comprises, a relatively rigid shell for covering the wearer's head. The headgear has a bumper for the shell comprising, a flexible cover attached to a front of the shell adjacent a lower front edge of the shell, with the cover having a recess facing the shell, and a pad of high energy attenuation material received in the recess.

A feature of the present invention is that substantially improved protection is provided by the bumper for the front part of the headgear.

Another feature of the invention is that the bumper may be constructed in a simplified manner.

Yet another feature of the invention is that the bumper may be readily attached to the front part of the shell.

Further features will become more fully apparent in the following description of the embodiments of this invention and from the appended claims.

DESCRIPTION OF THE PREFERRED EMBODIMENTS

Figure 1:
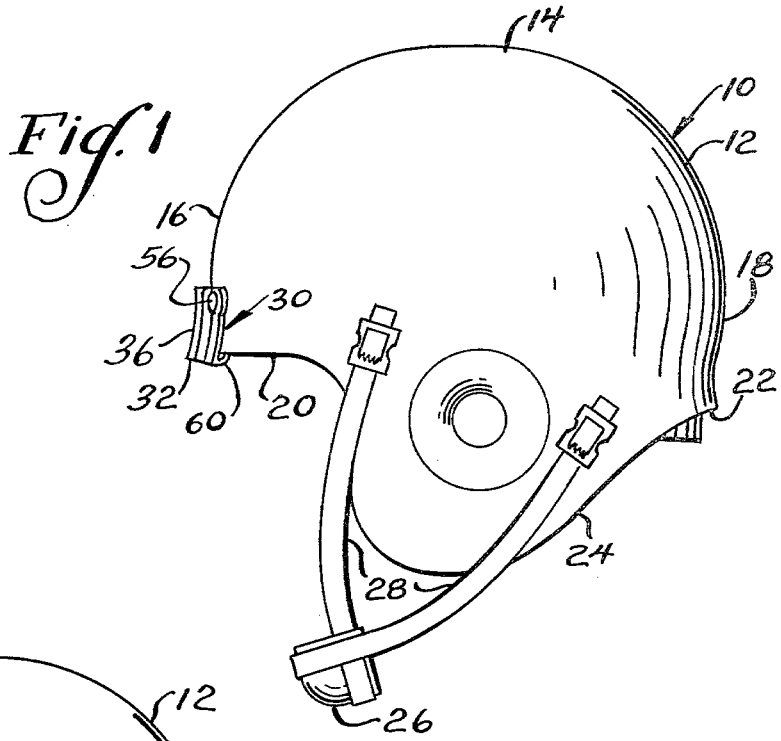
FIG. 1 is a side elevational view of a protective headgear having a bumper according to the present invention.
Figure 2:
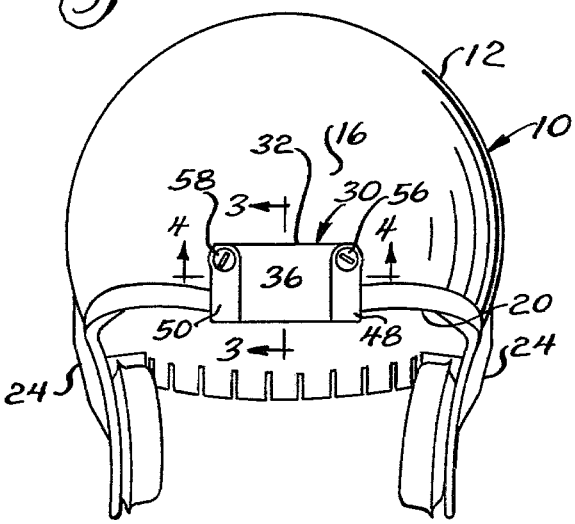
FIG. 2 is a front elevational view of the headgear of FIG. 1.
Figure 3:
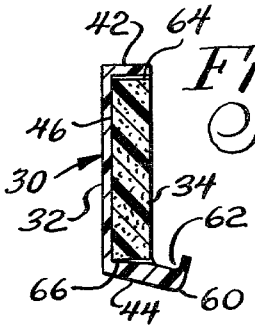
FIG. 3 is a sectional view of the bumper taken substantially as indicated along the line 3—3 of FIG. 2.
Figure 4:
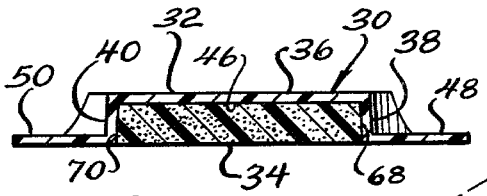
FIG. 4 is a sectional view of the bumper taken substantially as indicated along the line 4—4 of FIG. 2.
Figure 5:
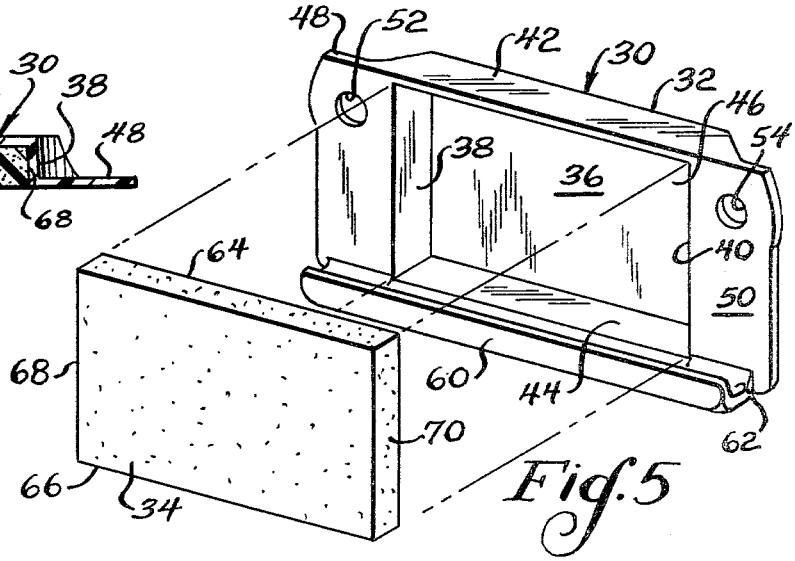
FIG. 5 is an exploded perspective view taken from the inside of the bumper for the headgear.

Referring now to FIGS. 1 and 2, there is shown a protective headgear or helmet generally designated 10. Although the helmet 10 is shown in the form of a football helmet, it will be understood that the principles of the invention may be utilized in connection with any other suitable headgear, such as hockey helmets, baseball helmets, crash helmets, or other headgear where protection of the head is desired. As shown, the helmet 10 has an outer shell 12 which is preferably made of a relatively rigid material, such as polycarbonate alloy, a rigid thermoplastic, or a thermosetting resin. The shell 12 has an upper central portion 14, a front portion 16, a rear portion 18, a lower front edge 20, a lower rear edge 22, and a pair of ear protectors 24. The headgear may also have a chin cup 26 releasably attached to the helmet by a pair of straps 28.

With reference to FIGS. 1–5, according to the present invention a bumper generally designated 30 is attached to a front portion of the shell 12 adjacent the lower front edge 20 of the shell 12. The bumper 30 has a flexible cover 32 which may be formed by molding from a suitable elastomeric material, such as Kraton G, a trademark of Shell Oil Company, and a pad 34. The cover 32 has a generally rectangular front wall 36, a pair of spaced sidewalls 38 and 40 extending inwardly from opposed sides of the front wall 36 toward the shell 12, a top wall 42 extending inwardly from an upper portion of the front wall 36 toward the shell 12, and a bottom wall 44 extending inwardly from a lower portion of the front wall 36 toward the shell 12. The top and bottom walls 42 and 44 connect the sidewalls 38 and 40 to define a generally rectangular recess 46 which faces the shell 12 for a purpose which will be discussed below.

The cover 32 has a pair of opposed retaining flanges 48 and 50 extending outwardly from inner ends of the sidewalls 38 and 40, respectively, with each of the retaining flanges 48 and 50 having an aperture 52 and 54 extending through an upper central portion of the respective retaining flanges 48 and 50. The headgear 10 has a pair of screws 56 and 58 which are passed through the apertures 52 and 54 into the shell 12 in order to secure the retaining flanges 48 and 50 and the cover 32 to the shell adjacent the lower front edge 20 of the shell 12. As shown, the cover 32 also has a protective flange 60 extending from the bottom wall 44 and the lower part of the retaining flanges 48 and 50 inwardly around the lower front edge 20 of the shell 12, such that the protective flange 60 defines a groove 62 to receive the lower front edge 20 of the shell 12.

The pad 34 may be constructed from a high energy attenuation foam, such as a butyl rubber foam, e.g., Decello 4024, sold by Freeland Associates of Detroit, Michigan. The pad 34 has a rectangular configuration, with a top edge 64, a bottom edge 66, and a pair of side edges 68 and 70 connecting the top and bottom edges 64 and 66. The pad 34 is received in the recess 46 of the cover 32, and the pad 34 has a shape to substantially fill the recess 46 intermediate the front wall 36 and the shell 12 when the cover 32 is secured to the shell 12 with the pad 34 in place in the recess 46. Thus, in accordance with the present invention the headgear 10 has a bumper 30 with a cover 32 to cover and retain the pad 34 in place on the lower front portion of the shell 12. During use, the protective flange 60 protects the lower front edge 20 of the shell from striking the wearer's nose. Also, the cover 32 and pad 34 provide the headgear with improved energy absorbing capabilities to dissipate forces applied against the front part of the shell, as will be described below.

One of the tests of protective headgear which may be run in the laboratory is called a drop test. The equipment for the drop test comprises a headform having three accelerometers mounted along mutually perpendicular axes, with the head form having the shape of the human head. The helmet to be tested is placed upon the headform, and the headform and attached helmet are raised to a specified height above a testing plate comprising a ½ inch thick rubber pad with a Shore durometer of 38A. The headform and attached helmet are then dropped from the specified height such that the helmet impacts against the testing. plate while the outputs of the accelerometers are monitored. The tests are repeated for different heights of the drop, and for different impact locations on the helmet.

The measured peak deceleration on the accelerometers is representative of the acceleration to the brain during the impact. A Severity Index is calculated from the outputs of the accelerometers according to the following formula:

$$\text{Severity Index} = \int_{t_1}^{t_2} a^{2.5} dt,$$

where a is the acceleration, and $t_1$ and $t_2$ are the times during the peak deceleration pulse. The Severity Index is a measure of the human tolerance level at which a person would be subjected to a possible concussion, or more generally the ability of the helmet to absorb the impact. The lower the value of the Severity Index, the better the protection afforded by the helmet and the less likely the person would have a concussion under the impact.

Drop tests were conducted in the laboratory on a helmet without the bumper of the present invention and on the helmet with the bumper attached. Of course, the impact location during the drop tests was the front of the helmet where the bumper is attached. The test results are set forth in the following table for the Severity Index obtained from both helmets under the specified height of the drop.

SEVERITY INDEX - FRONT BLOW

| Drop Height (inches) | Helmet without Bumper | Helmet with Bumper |
|---|---|---|
| 36 | 704 | 242 |
| 48 | 1389 | 575 |
| 60 | 2072 | 1040 |
| 60 | 2192 | 1128 |

In every case of the drop test, the Severity Index for the helmet of the invention was substantially less than the corresponding data for the helmet without the bumper, thus indicating that the helmet of the invention is substantially better in affording protection in the front for the wearer than the helmet without the bumper.

The foregoing detailed description is given for clearness of understanding only, and no unnecessary limitations should be understood therefrom, as modifications will be obvious to those skilled in the art.

I claim:

1. Protective headgear, comprising:

a relatively rigid shell for covering the wearer's head, said shell having an outer surface, and an inner surface facing toward the wearer's head; and a bumper for the shell comprising, a flexible cover attached to a front of the shell adjacent a lower front edge of the shell, said cover having a recess facing the front surface of the shell, and including a flange extending from a lower portion of the cover around the lower front edge of the shell, said flange having an upwardly directed inner lip engaging the inner surface of the shell in an area only adjacent the edge of the shell, with said area extending continuously from the edge of the shell in a direction upwardly from the edge, and a pad of high energy attenuation material received in said recess intermediate the cover and shell and extending over only the outer surface of the shell.

2. The headgear of claim 1 wherein said cover has a pair of flanges on opposed sides of said recess, with said flanges being located against the shell, and means for securing said flanges to the shell.

3. The headgear of claim 2 wherein each of said flanges has an aperture extending through the flange, and in which the securing means comprises a pair of screws extending through the apertures into said shell.

4. The headgear of claim 1 wherein said pad comprises foam.

5. The headgear of claim 4 wherein said pad comprises a butyl rubber foam.

6. The headgear of claim 1 wherein said cover comprises an elastomeric material.

7. Protective headgear, comprising:

a relatively rigid shell for covering the wearer's head, said shell having an outer surface, and an inner surface facing the wearer's head; and a bumper for the shell comprising, a flexible cover attached only to the outer surface of the shell adjacent a lower front edge of the shell, said cover having a flat front wall, a pair of spaced sidewalls extending from opposed sides of the front wall toward the shell, a top wall extending from an upper portion of the front wall toward the shell, a bottom wall extending from a lower portion of the front wall toward the shell, said top and bottom walls connecting said sidewalls to define a recess facing the outer surface of the shell, a protective flange extending from said bottom wall around the lower front edge of the shell, said flange having an upwardly directed inner lip engaging the inner surface of the shell in an area only adjacent the edge of the shell, with said area extending continuously from the edge of the shell in a direction upwardly from the edge, a pair of opposed retaining flanges extending outwardly from inner ends of said sidewalls, said bumper being of one-piece construction, means for securing said retaining flanges to the shell, and a pad of high energy attenuation foam received in and substantially filling said recess intermediate said front wall and the shell, said pad extending over only the outer surface of the shell.

8. The headgear of claim 7 wherein said recess and pad have a generally rectangular configuration.

9. The headgear of claim 7 wherein said protective flange defines a groove to receive the lower front edge of the shell.

* * * * *